US005419243A

United States Patent [19]

Hanzawa et al.

[11] Patent Number: 5,419,243

[45] Date of Patent: May 30, 1995

[54] ROTARY STENCIL PRINTER EQUIPPED WITH PINCH ROLLER POSITION CONTROL MEANS

[75] Inventors: Hiroshi Hanzawa; Yoshikazu Hara; Masakazu Miyata; Koji Nakayama, all of Tokyo, Japan

[73] Assignee: Riso Kagaku Corporation, Tokyo, Japan

[21] Appl. No.: 289,030

[22] Filed: Aug. 11, 1994

[30] Foreign Application Priority Data

Aug. 18, 1993 [JP] Japan ..... 5-225162

[51] Int. Cl.[6] ..... B41L 13/04

[52] U.S. Cl. ..... 101/116; 101/118

[58] Field of Search ..... 101/116, 117, 118, 120, 101/122, 129, 409, 410; 400/636.1

[56] References Cited

U.S. PATENT DOCUMENTS 5,081,924 1/1992 Ohinata ..... 101/116

5,243,904 9/1993 Hayama et al. ..... 101/116

FOREIGN PATENT DOCUMENTS 1204781 8/1989 Japan .

4105984 4/1992 Japan .

4361043 12/1992 Japan .

*Primary Examiner*—Edgar S. Burr

*Assistant Examiner*—Stephen R. Funk

*Attorney, Agent, or Firm*—Stevens, Davis, Miller & Mosher

[57] ABSTRACT

In a rotary stencil printer in which a back press roller 12 is provided with a transverse groove 26 for receiving a transverse bar 16 of a printing drum 10 and a printing sheet applied with a printing at a nipping region 32 between the printing drum and the back press roller is transferred for a while as attached onto the cylindrical outer circumferential surface of the back press roller by a pinch roller or rollers 40 provided at an outlet side of the nipping region so as to press at a side edge portion or portions of the printing sheet against the outer circumferential surface of the back press roller, the position control of the pinch roller or rollers to conform to the sheet width is carried out in a condition that the pinch roller or rollers are aligned with the transverse groove of the back press roller.

4 Claims, 4 Drawing Sheets

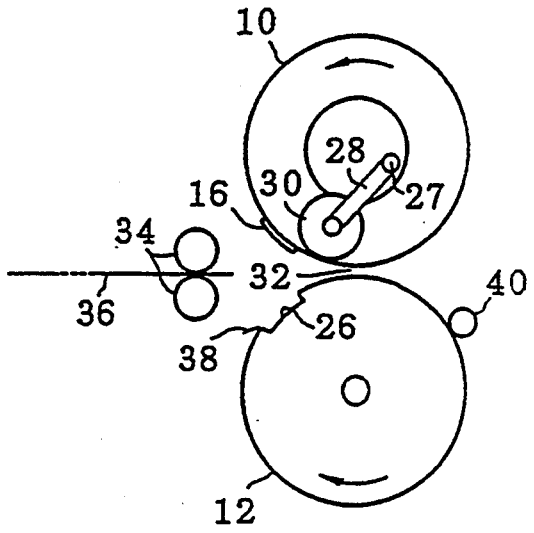
FIG. 1(A)
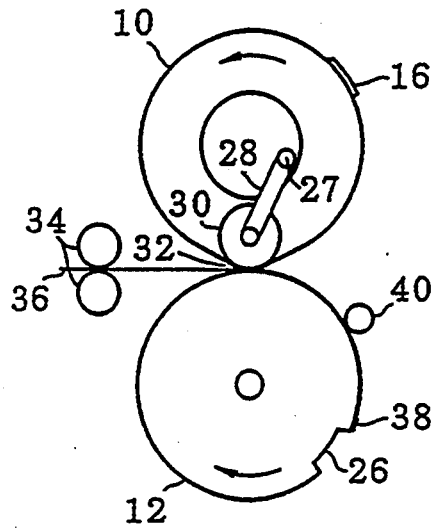
FIG. 1(B)
FIG. 2
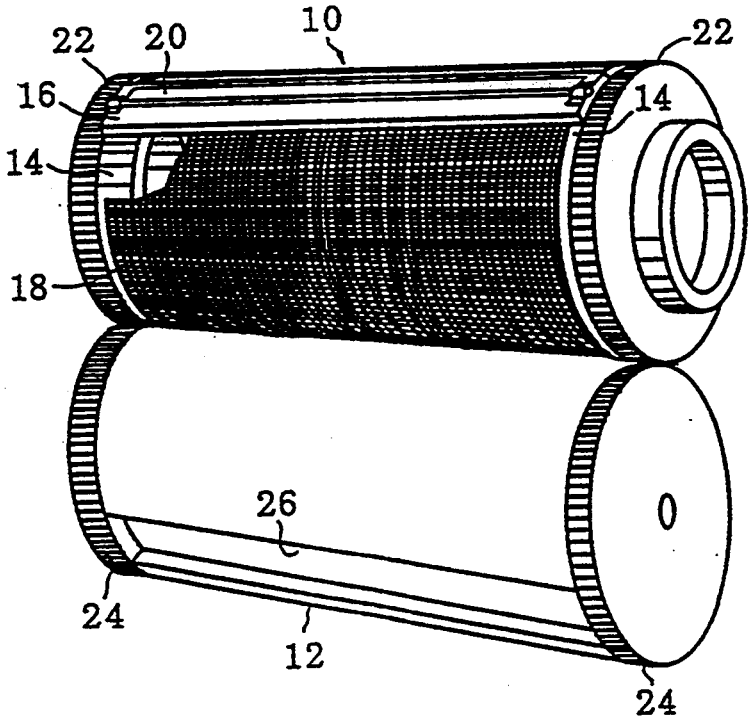

ROTARY STENCIL PRINTER EQUIPPED WITH PINCH ROLLER POSITION CONTROL MEANS

BACKGROUND OF THE INVENTION

1. Field of the Invention

The present invention relates to a rotary stencil printer, and more particularly to a rotary stencil printer having a pinch roller or rollers adapted to press at least one of opposite side edge portions of a sheet discharged from a nipping region between a printing drum and a back press roller against the back press roller such that the sheet moves for a while as attached onto the back press roller.

2. Description of the Prior Art

In the stencil printing art according to which ink is supplied on one surface of a stencil sheet in the form of a layer, then the stencil sheet is laid on a surface to receive printing so as to be in contact therewith at the other surface thereof, and then a pressing force is applied to the ink layer by a pressing means such that the ink of the ink layer is transferred from said one surface to said other surface of the stencil sheet thereby giving an ink image on the surface to receive printing, it has been proposed by Japanese Patent Laid-open Publication 4-361043 to accomplish such a stencil printing in a manner of hardly causing a back inking of the printed sheets even when they are laid one over the other just after the printing according to such an art that after the ink has been transferred through the perforations of the stencil sheet, the printed surface is detached from the stencil sheet while the pressing means is still kept in its pressing position such that the ink of the ink layer is substantially kept under the control of the pressing means against flowing relative to the stencil sheet, whereby when the printed sheet is removed from the stencil sheet, the ink is retained on the stencil sheet not to be drawn out of the ink layer due to the viscosity of the ink, thereby preventing any excessive ink from being transferred onto the printed surface.

In the above-mentioned publication, there is shown an embodiment for carrying out such a stencil printing art in a rotary stencil printer, according to which a printing sheet nipped between a printing drum bearing a perforated stencil sheet around a cylindrical circumferential surface thereof and a back press roller and applied with a printing at the nipping region under an action of an inking roller acting as a means for pressing ink from the inside of the printing drum to thereby urge the ink radially outwardly of the printing drum is moved for a while as attached onto a cylindrical circumferential surface of the back press roller such that the printing sheet moving along an arcuate contour of the movement of the circumferential surface of the back press roller is detached from the stencil sheet wrapped around the printing drum at an early stage while the ink layer of the printing drum is still kept under the control of the inking roller with the ink being substantially prohibited of any free flow thereof, and as a means for transferring the printing sheet discharged from the nipping region as so attached to the outer circumferential surface of the back press roller there are provided a damp for fastening the leading edge of the printing sheet to the outer circumferential surface of the back press roller along a generatrix thereof and pinch rollers adapted to press opposite side edge portions of the printing roller against the outer circumferential surface of the back press roller.

The rotary stencil printer schematically shown in the above-mentioned laid-open publication has a construction that the printing drum and the back press roller have the same diameter as one another. When the printing drum of such a rotary stencil printer is constructed to have a perforated flexible circumferential wall which can slightly bulge radially outwardly at a portion thereof extending along a generatrix thereof when the portion is pressed radially outwardly by an inking roller arranged along the inside surface thereof in parallel with said generatrix as shown in Japanese Patent Laid-open Publication 1-204781, there is obtained an advantage that the distance between the central axes of the printing drum and the back press roller may be fixed at such a constant value that provides a small clearance between the flexible circumferential wall of the printing drum and the back press roller when the flexible circumferential wall of the printing drum is not bulged out by the inking roller so that the switching over between an operating condition in which the printing drum and the back press roller nip a printing sheet at a nipping region therebetween for carrying out printing and a non-operating condition in which no printing sheet is supplied between the printing drum and the back press roller and therefore the back press roller must be removed off from the printing drum so as not to be contaminated with the ink of the printing drum by a direct contact therewith need not be carried out in the manner of changing the distance between the central axes of the printing drum and the back press roller as is in the conventional printer having a rigid printing drum but can be carried out in a manner of controlling the selective bulging out of the flexible circumferential portion of the printing drum by the inking roller.

As is shown in the above-mentioned Japanese Patent Laid-open Publication 1-204781, the printing drum having the above-mentioned flexible circumferential wall is in fact so constructed that a rectangular perforated sheet such as a net material to provide the flexible circumferential wall is rolled with opposite side edge portions thereof being seated around a pair of annular members firmly connected with one another by a transverse bar bridged therebetween so as to provide opposite end portions of the printing drum, said transverse bar also serving as a means for mounting the leading edge of the stencil sheet wrapped around the circumferential surface of the printing drum. And further, in order to meet with the matter that the printing drum exhibits an outer configuration having a portion somewhat radially outwardly projecting from the cylindrical contour of the circumferential wall at the part of the transverse bar, the back press roller is formed with a transverse groove extending along a generatrix thereof at a part thereof which encounters with the transverse bar of the printing drum when it is rotated in synchronization with the printing drum in a rotational direction opposite to that of the printing drum.

When the opposite side edge portions of a printing sheet are pressed against the outer circumferential surface of the back press roller by the above-mentioned pinch rollers, it is required that the position of the pinch rollers is precisely determined such that they are each aligned to a narrow region extending along a side edge of the sheet so as not to contact and damage the just printed print image. Therefore, when the width of the printing sheet changes, the position of the pinch rollers along the axis of the back press roller must be readjusted. However, since the pinch rollers are pressed against the outer circumferential surface of the back press roller under a certain elastically pressing force so that the printing sheet is tightly attached against the outer circumferential surface of the back press roller, shifting of the pinch rollers relative to the back press roller along the axis thereof will be resisted by a relatively large friction force.

SUMMARY OF THE INVENTION

In view of the above-mentioned problems with respect to the adjustment of the position of the pinch rollers, it is an object of the present invention to definitely accomplish the adjustment of the pinch roller position by as simple a construction as possible without employing any strong driving means for the adjustment of the pinch roller position or such particular means as to first lift the pinch rollers off the outer circumferential surface of the back press roller for eliminating the contact therebetween at the time of adjustment of the pinch roller position but by effectively utilizing the above-mentioned transverse groove in the case of a rotary stencil printer incorporating such a transverse groove.

According to the present invention, the above-mentioned object is accomplished by a rotary stencil printer comprising a printing drum and a back press roller adapted to rotate about each central axis thereof, said printing drum having a transverse bar for mounting a leading edge of a stencil sheet along a generatrix of a cylindrical circumferential surface thereof, said back press roller having a transverse groove along a generatrix of a cylindrical circumferential surface thereof arranged to meet with said transverse bar of said printing drum for receiving said transverse bar therein, wherein a sheet discharged from a nipping region between said printing drum and said back press roller with a print being applied thereon in said nipping region moves for a while as attached onto the cylindrical circumferential surface of said back press roller with at least one side edge portion thereof being pressed against the cylindrical circumferential surface of said back press roller by at least one pinch roller, characterized by further comprising a pinch roller position adjusting means for adjusting an axial position of said pinch roller so as to conform to a width of the sheet, said pinch roller position adjusting means being adapted to move said pinch roller in the axial direction for adjustment of the axial position thereof when said pinch roller is in alignment with said transverse groove of said back press roller.

When the adjustment of the pinch roller position is carried out in the condition that the transverse groove of the back press roller is in alignment with the pinch roller or rollers as described above, since the pinch roller or rollers are out of contact with the outer circumferential surface of the back press roller, the pinch roller or rollers can freely move along the axis of the back press roller with no resistance due to the contact with the back press roller. Therefore, only by detecting a rotational position of the back press roller at which the pinch roller or rollers just align with the transverse groove by employing an appropriate detection means, it is possible to rationalize the construction of the means for adjusting the pinch roller position. It is possible by a very simple position detecting means to detect whether the back press roller has attained a predetermined rotational position or not. Alternatively, when the back press roller is rotated from a predetermined rest position at a predetermined rotation speed, the above-mentioned rotational position can be easily detected by measuring the lapse of a predetermined time by a timer.

When a pair of the pinch rollers are provided, they may be adjustable of the axial positions thereof in symmetry with respect to a central position therebetween.

Such a pair of pinch rollers may each be supported by each one of a pair of carriers, while each said carrier is supported by a pair of parallel arranged screw rods extending along the central axis of said back press roller through screw engagement between a female thread on the side of said carrier and a male thread on the side of said rod, wherein helical directions of said female and male threads at the respective screw engagements are arranged such that when said pair of rods are rotated in synchronization with one another in relatively opposite directions, said pair of carriers approach to one another or depart from one another according to direction of rotation with respect of one of said pair of rods.

In the above-mentioned construction, when the axial positions of said pinch rollers are readjusted, said pair of carriers may first be moved to respective home positions at which they are moved to be remote from one another unless they are already at said home positions, and then said pair of carriers may be moved to approach to one another by a controlled amount.

BRIEF DESCRIPTION OF THE DRAWING

In the accompanying drawing,

FIGS. 1A and 1B are schematic views showing the basic construction of a rotary stencil printer to which the pinch roller position control means according to the present invention is applied;

FIG. 2 is a perspective view showing the constructions of the printing drum and the back press roller of the rotary stencil printer shown in FIG. 1 in more detail;

DESCRIPTION OF THE PREFERRED EMBODIMENT

Figure 3:
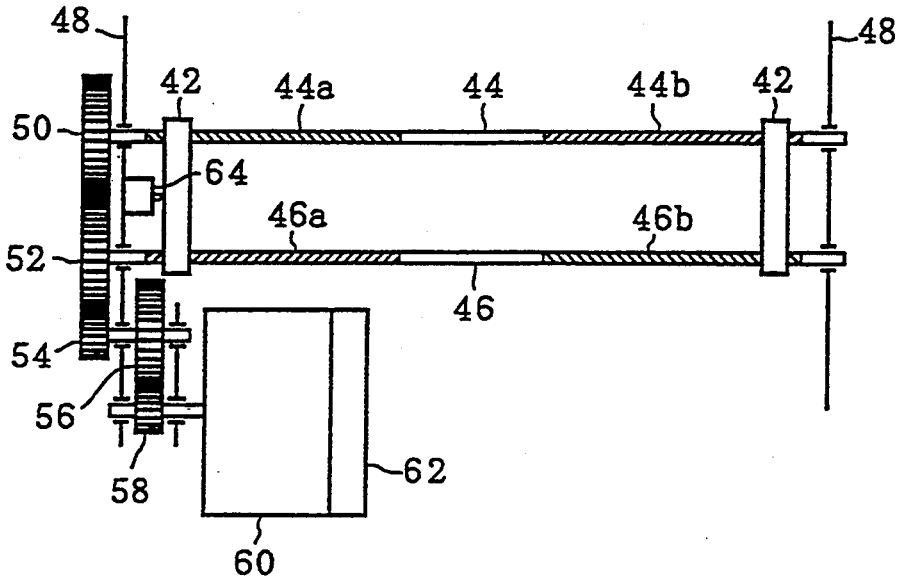
FIG. 3 is a somewhat schematic plan view showing an embodiment of the mechanical part of the pinch roller position control means according to the present invention.

The present invention will now be described in more detail with respect to an embodiment thereof with reference to the accompanying drawing.

Referring to FIG. 1 showing the basic construction of a rotary stencil printer having pinch rollers which form an object of which the present invention is embodied, 10 is a printing drum and 12 is a back press roller. The printing drum and the back press roller are supported by a housing of the printer not shown in the figure so as to be rotatable about the respective central axes fixed to the housing and are adapted to rotate about said central axes in synchronization with one another in relatively opposite directions as shown by arrows in the figure. More concrete constructions of the printing drum 10 and the back press roller 12 are shown in FIG. 2. As shown in this figure, the printing drum has a pair of annular members 14 firmly connected with one another by a transverse bar 16 extending along a generatrix of the printing drum and a rectangular perforated flexible sheet made of a net material or the like mounted around the pair of annular members with opposite side edge portions thereof being slidably seated along the outer circumferential surfaces of the annular members so as to provide an ink permeable circumferential wall of the printing drum. On the transverse bar 16 there is mounted a clamp 20 for fastening a leading edge of a stencil sheet. The pair of annular members 14 are each provided with a gear wheel 22.

The back press roller 12 is a roller having a rigid outer circumferential surface of the same diameter as the printing drum, and has gear wheels 24 at opposite axial ends thereof, the gear wheels 24 having the same number of teeth as the gear wheels 22 of the printing drum. By messing engagement between the gear wheels 22 and 24 the printing drum 10 and the back press roller 12 rotate in synchronization with one another in relatively opposite directions. The back press roller is formed with a transverse groove 26 along a generatrix portion thereof which meets with the transverse bar 16 during the synchronized relatively opposite rotations.

Returning to FIG. 1, an inking roller 30 is provided inside the printing drum 10 as supported by a pair of arm members 28 swingable about an axis 27. The inking roller 30 is a roller extending in parallel with generatrices of the printing drum 10 and having an axial length slightly smaller than the distance between the opposing inner edges of the annular members 14 forming the opposite axial ends of the printing drum. When the inking roller 30 is urged radially outwardly relative to the printing drum by the arms 28 being swung, a portion along a generatrix of the flexible circumferential wall of the printing drum made of the flexible sheet 18 contacted by the inking roller 30 is bulged radially outwardly of the printing drum. In the condition shown in FIG. 1A, such a bulging out of the flexible circumferential wall by the inking roller 30 is not carried out, and in this condition there is left a small clearance enough to avoid any direct contact between the cylindrical circumferential surfaces of the printing drum and the back press roller at a nipping region 32 formed between opposing portions thereof. In the condition shown in FIG. 1B, the flexible circumferential wall of the printing drum is bulged radially outwardly by the inking roller 30 at the position of the nipping region 32 so that the clearance at the nipping region is cancelled.

In FIG. 1, 34 shows a pair of printing sheet feed rollers which nip a printing sheet 36 therebetween and feed it toward the nipping region 32 for carrying out printing. The back press roller 12 is provided with a clamp 38 along an edge of the transverse groove 26 for fastening a leading edge of the printing sheet 36 onto the back press roller 12 just before the leading edge enters into the nipping region 32. Adjacent the outlet side of the nipping region 32 a pair of pinch rollers 40 are provided as pressed against the outer circumferential surface of the back press roller 12.

When the printing process proceeds from the condition shown in FIG. 1A, the condition shown in FIG. 1B is attained. Here the printing sheet 36 is applied with a printing at the nipping region 32 according to the perforations of the stencil sheet mounted around the printing drum 10, and is continually transferred for a while in such a condition that it is attached against the cylindrical circumferential surface of the back press roller with the leading edge thereof being fastened to the back press roller by the clamp 38 while the opposite side edge portions thereof being pressed against the cylindrical circumferential surface of the back press roller by the pair of pinch rollers 40. In this manner the printing sheet is supplied with an ink image according to the perforations of the stencil sheet at the nipping region 32 with the ink of the ink layer supplied to the printing drum from the inside thereof and pressed by the inking roller 30, and while the ink layer is kept in the condition pressed by the inking roller, the printing sheet moving along an arc contour following the cylindrical circumferential surface of the back press roller is promptly peeled off from the stencil sheet mounted around the printing drum, whereby a uniform printing with a necessary minimum amount of ink not to cause the back inking is provided on the printing sheet. Thereafter, the clamp 38 is released, and the printing sheet 36 is transferred to be removed from the back press roller toward a sheet receptacle.

Figure 4:
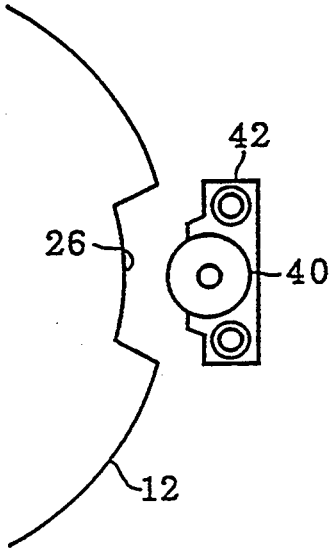
FIG. 4 is a side view of a part of the mechanical construction shown in FIG. 3.

FIGS. 3 and 4 are somewhat schematic plan and side views of an embodiment of the construction for supporting the pinch rollers 40 to allow for the adjustment of the positions thereof along the axis of the back press roller. In these figures, 42 are a pair of carriers supporting the respective pinch rollers. The carriers are each supported at opposite ends thereof by a pair of screw rods 44 and 46 in screw engagement with threaded portions **44*a* and 46*a* or 44*b* and 46*b* thereof. The screw rods 44 and 46 are rotatably supported by a housing 48 of the printer at respective opposite ends and bear gear wheels 50 and 52, respectively, so that they are rotated in synchronization with one another in relatively opposite directions by the messing of these gears. The threaded portions 44*a* and 44*b* are relatively oppositely helical, while the threaded portions 46*a* and 46*b* are also relatively oppositely helical. Further the threaded portions 44*a* and 46*a* are relatively oppositely helical, while the threaded portions 44*b* and 46*b* are relatively oppositely helical. Therefore, when the pair of messing gear wheels 50 and 52 are driven by a motor 60 through a gear train including pinion 54, gear wheel 56 and pinion 58, the pair of carriers 42 approach to one another or depart from one another in symmetry with respect to the central point therebetween according to switching over of the direction of rotation of the motor 60. The rotation of the motor 60 is detected by an encoder 62**.

Although the construction shown in FIG. 3 uses only one reversible motor 60 in order to show an example of the construction by which the pair of pinch rollers 40 are moved in symmetry relative to the central point of the width of printing, a pair of pinch rollers need not necessarily be moved in symmetry relative to the central point of the printing width, and only a single pinch roller may be provided to press only one side edge portion of the printing sheet. Such modifications as to adjust the position of each one of a pair of pinch rollers independently of one another, to shift the central position of a pair of pinch rollers toward one or the other side, or to adjust the position of only a single pinch roller provided along one side edge of the printing sheet are matters of design optionally employable by those skilled in the art based upon the teaching of the present invention. Therefore, the shown embodiment is not to limit the present invention.

FIG. 4 shows the pinch rollers 40 supported by the construction shown in FIG. 3 and the transverse groove 26 of the back press roller 12 in a condition in which they are in alignment with one another. When the transverse groove 26 is aligned with the pinch rollers 40 as shown in the figure, the pinch rollers 40 are released from the contact with the cylindrical circumferential surface of the back press roller. Therefore, when the motor 60 is operated, the pair of pinch rollers 40 can freely move along the axis of the back press roller without being obstructed of its movement by the contact with the back press roller. When the carriers 42 reach the respective positions remotest from one another, i.e. the positions closest to the respectively adjacent housing walls (home positions), it is detected by a pinch roller home position sensor 64 which is a limit switch. The home positions of the carriers may be so determined that when the carriers are at the respective home positions, the pair of pinch rollers 40 take the positions just engaging the opposite side edge portions of a printing sheet having the maximum width usable in the printer, or a little outside of such positions.

Figure 5:
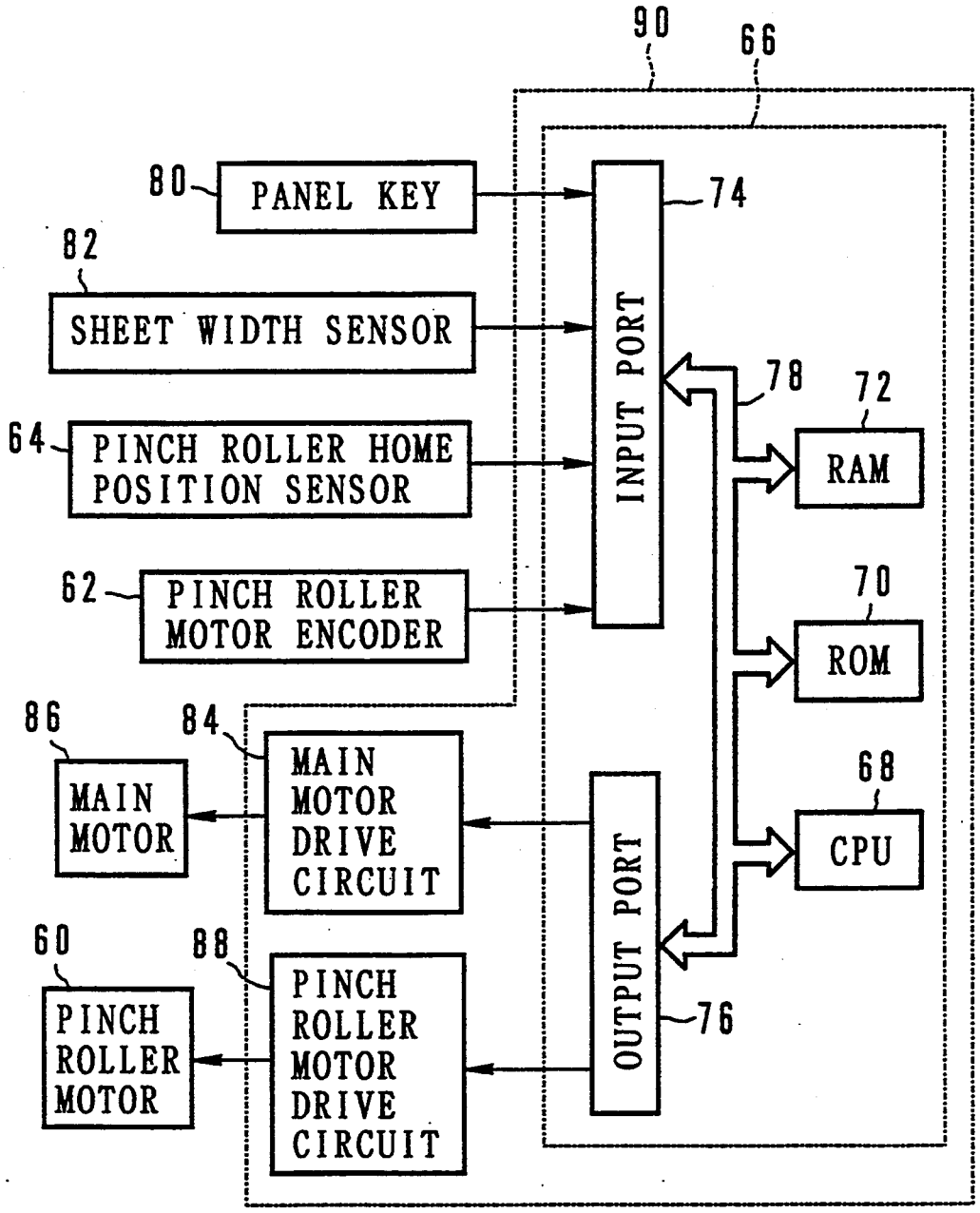
FIG. 5 is a diagrammatic view showing an embodiment of the electric control part of the pinch roller control means according to the present invention.

The construction for controlling the pinch roller position described above shows a mechanical part of one embodiment of the pinch roller position control means according to the present invention. The control operation for adjusting the position of the pinch rollers so as to conform to the size of the printing sheet by the above-mentioned mechanical construction is carried out by an electric control circuit adapted to operate based upon the signals dispatched from the encoder 62 of the motor 60, the pinch roller home position sensor 64, a panel key for instructing the pinch roller position control and a sheet width sensor for detecting the width of the printing sheet. FIG. 5 is a diagram showing an embodiment of such an electric control circuit.

In FIG. 5, 66 is an electronic calculation control circuit (computer) which comprises central calculation means (CPU) 68, read only memory (ROM) 70, random access memory (RAM) 72, input port means 74, output port means 76 and common bus 78 connecting these elements with one another. The computer 66 is supplied with signals from a panel key 80 for instructing control of the pinch roller position, a sheet width sensor 82 for detecting the width of a printing sheet, the pinch roller home position sensor 64 and the pinch roller motor encoder 62 through the input port means 74. The computer 66 carries out calculations for the control of the pinch roller position according to the below-mentioned manner based upon these input signals and selectively operates a main motor 86 for driving the printing drum 10 through a main motor drive circuit 84 and also selectively operates the pinch roller motor 60 through a pinch roller motor drive circuit 88. The computer 66, the main motor drive circuit 84 and the pinch roller motor drive circuit 88 constitute an electric control part 90 of the pinch roller position control means.

Figure 6:
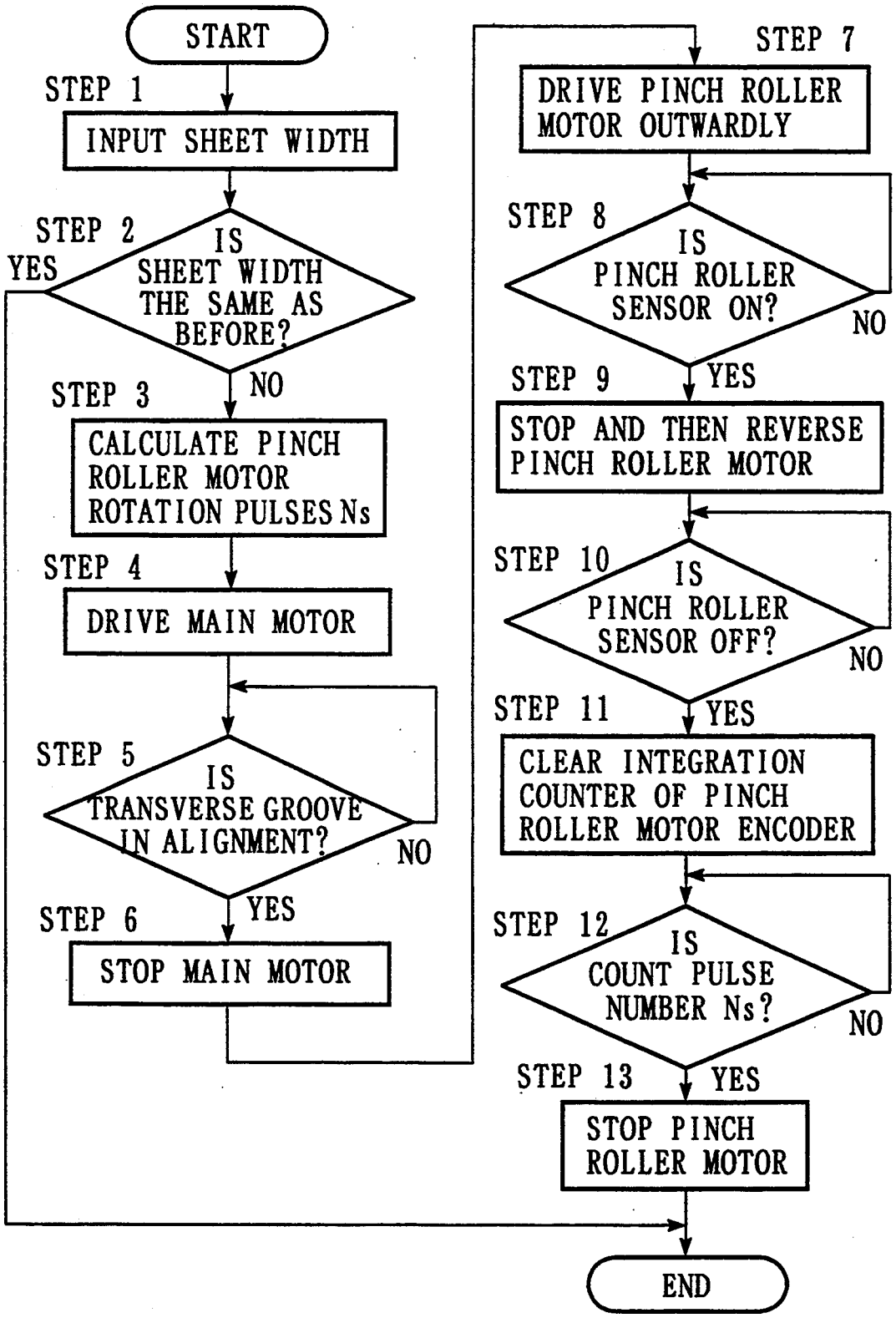
FIG. 6 is a flowchart showing the control operation carried out by the control means shown in FIGS. 3–5.

FIG. 6 is a flowchart showing the manner of control of the pinch roller position by the control means shown in FIGS. 3–5. When the pinch roller position control operation is started by the panel key 80 being pushed, first in step 1, the width of the printing sheet is detected by the sheet width sensor 82, and a corresponding signal is input to computer 66.

Then in step 2, it is judged if the sheet width newly input is the same as the sheet width already input at the preceding pinch roller position control or not. If the judgement is "yes", there is no need to newly control the pinch roller position, and therefore the control operation is immediately ended. If the judgement in step 2 is "no", the control process proceeds to step 3, in which a pulse number Ns required for the below-mentioned rotation control of the pinch roller motor is calculated based upon the detected sheet width, and then the control process proceeds to step 4.

In step 4, driving of the main motor is started in order to let the transverse groove 26 of the back press roller align with the pinch rollers 40. It is desirable that the driving of the main motor for this purpose is carried out at a lower speed than the speed thereof during the printing process. Then in step 5, it is judged if the transverse groove 26 has come to a position of alignment with the pinch rollers 40. Since the rotation or rotational position of the printing drum of this type of rotary stencil printer is always kept under the control of the printing drum driving means not shown in the figure, it is readily possible to detect that the printing drum has come to a particular rotational position at which the transverse groove 26 of the back press roller aligns with the pinch rollers 40, as the back press roller rotates in synchronization with the printing drum in the relatively opposite direction and the transverse groove 26 is always at a mirror reflected position of the transverse bar 16 with respect to a phantom plane traversing between the printing drum and the back press roller at right angle to a phantom plane including both the central axes of the printing drum and the back press roller. Or alternatively, a particular sensor, though not shown in the figure, may be provided to directly detect the particular rotational position of the back press roller at which the transverse groove 26 aligns with the pinch rollers 40. As long as the judgement is "no", step 5 is repeated. The control flow in the electronic control means expressed by this kind of flowchart is generally repeated at a cycle of 10 ms.

When it was judged that the transverse groove has aligned with the pinch rollers in step 5, giving judgement "yes", the control process proceeds to step 6, in which the main motor is stopped, and then in step 7, the pinch roller motor 60 is driven outwardly. The outward driving of the pinch roller motor is herein defined as a rotation thereof by which the pair of carriers 42 are moved to depart from one another, i.e. toward the respective home positions. After the outward driving of the pinch roller motor has been instructed, in step 8 it is judged if the pinch roller home position sensor 64 is put on or not, i.e. if the carriers 42 have reached the home positions, or not.

If the judgement in step 8 is "yes" from the very beginning (this is the case that the pinch rollers are originally at the home positions when the instruction of step 7 was despatched) or if the judgement has turned from "no" to "yes", the control process proceeds to step 9, in which the pinch roller motor is stopped, and then the rotation of the pinch roller motor is reversed. In practice, it is desirable that a small delay time such as 200 ms is taken between the stopping and the reversal operation of the pinch roller motor in consideration of the mechanical inertia of the device. After the reversal rotation of the pinch roller motor has been started, i.e. the pair of carriers 42 have started to move toward one another, in step 10 it is judged if the pinch roller sensor 64 was put off or not. If the judgement in step 10 turned from "no" to "yes", the control process proceeds to step 11, in which an integration counter of the pinch roller motor encoder 62 is cleared, so that the counter starts a new counting. Then the control process proceeds to step 12, in which it is judged if the encoder count pulse number has reached the pulse number Ns set in step 3 or not. The pulse number Ns corresponds to the rotation of the pinch roller motor 60 required for shifting the carriers 42 from the home positions to the positions to conform to the sheet width input in step 1. When the encoder count pulse number has reached Ns, i.e. the judgement in step 12 has turned from "no" to "yes", the control process proceeds to step 13, in which the pinch roller motor 60 is stopped, and the control process is ended.

Although the present invention has been described in detail in the above with respect to an embodiment thereof, it will be apparent for those skilled in the art that various modifications are possible with respect to the shown embodiment within the scope of the present invention.

We claim:

1. A rotary stencil printer comprising a printing drum and a back press roller each adapted to rotate about a central axis thereof, said printing drum having a transverse bar for mounting a leading edge of a stencil sheet along a generatrix of a cylindrical circumferential surface thereof, said back press roller having a transverse groove along a generatrix of a cylindrical circumferential surface thereof arranged to meet with said transverse bar of said printing drum for receiving said transverse bar therein, at least one pinch roller for engagement with said back press roller, wherein a sheet discharged from a nipping region between said printing drum and said back press roller with a print being applied thereon in said nipping region, moves on the cylindrical circumferential surface of said back press roller with at least one side edge portion thereof being pressed against the cylindrical circumferential surface of said back press roller by said at least one pinch roller, and a pinch roller position adjusting means for adjustably changing an axial position of said at least one pinch roller to conform to a width of the sheet only when said at least one pinch roller is in alignment with said transverse groove of said back press roller.

2. A rotary stencil printer according to claim 1, wherein said at least one pinch roller comprises a pair of pinch rollers.

3. A rotary stencil printer according to claim 2, wherein said pair of pinch rollers are each supported by one of a pair of carriers, while each said carrier is supported by a pair of parallel screw rods extending along the central axis of said back press roller through screw engagement between a female thread on the side of said carrier and a male thread on the side of said rod, wherein helical directions of said female and male threads at the respective screw engagements are arranged such that when said pair of rods are rotated in synchronization with one another in relatively opposite directions, said pair of carriers approach one another or depart from one another in symmetry according to direction of rotation with respect of one of said pair of rods.

4. A rotary stencil according to claim 3, wherein said pinch roller position adjusting means further includes means to first move said pair of carriers to home positions spaced apart from each other, and second to move said pair of carriers toward one another to conform to the width of the sheet.

* * * * *